US007320402B2

(12) United States Patent
Lewis

(10) Patent No.: US 7,320,402 B2
(45) Date of Patent: Jan. 22, 2008

(54) PORTABLE LAPTOP DISPLAY AND STORAGE APPARATUS

(75) Inventor: Anthony Gordon Lewis, Englewood, NJ (US)

(73) Assignee: Howmedica Osteonics Corp., Mahwah, NJ (US)

( * ) Notice: Subject to any disclaimer, the term of this patent is extended or adjusted under 35 U.S.C. 154(b) by 674 days.

(21) Appl. No.: 10/777,809

(22) Filed: Feb. 12, 2004

(65) Prior Publication Data

US 2005/0178682 A1 Aug. 18, 2005

(51) Int. Cl.
*B65D 85/00* (2006.01)

(52) U.S. Cl. ..... 206/320; 190/16; 190/1

(58) Field of Classification Search ..... 190/1, 190/16, 102, 107, 113, 902; 206/305, 320
See application file for complete search history.

(56) References Cited

U.S. PATENT DOCUMENTS

| | | | | |
|---|---|---|---|---|
| 325,555 | A | 9/1885 | Meurer et al. | |
| 1,783,453 | A | 12/1930 | Reisert | |
| 1,796,962 | A * | 3/1931 | Ritter, Jr. | 190/107 |
| 2,159,995 | A | 5/1939 | Lifton | |
| 2,565,969 | A | 8/1951 | Judson | |
| 2,714,433 | A | 8/1955 | Wilson | |
| 2,822,013 | A * | 2/1958 | Renz | 190/126 |
| 2,829,778 | A | 4/1958 | Carabet | |
| 3,848,735 | A | 11/1974 | Mcgee et al. | |
| 4,066,155 | A | 1/1978 | Buchek | |
| 4,798,294 | A | 1/1989 | Bodi | |
| 4,813,521 | A | 3/1989 | Goldstone | |
| 4,932,506 | A | 6/1990 | Kim | |
| 4,966,258 | A * | 10/1990 | Hawley | 190/4 |
| 5,082,094 | A * | 1/1992 | Nechushtan | 190/105 |
| 5,090,562 | A | 2/1992 | Grullemans | |
| 5,307,909 | A | 5/1994 | Nitkin et al. | |
| 5,484,063 | A * | 1/1996 | Cuccio et al. | 206/722 |
| 5,570,780 | A | 11/1996 | Miller | |
| 5,835,344 | A | 11/1998 | Alexander | |
| 5,857,568 | A * | 1/1999 | Speirs | 206/320 |
| 5,996,749 | A * | 12/1999 | Hillsberg et al. | 190/109 |
| 6,116,418 | A | 9/2000 | Sadow | |
| 6,145,661 | A * | 11/2000 | Jung | 206/320 |
| 6,318,552 | B1 | 11/2001 | Godshaw | |
| 6,349,820 | B1 | 2/2002 | Kelley et al. | |
| 6,352,155 | B1 | 3/2002 | Barber | |
| 6,354,065 | B1 | 3/2002 | Horton et al. | |
| 6,547,071 | B2 | 4/2003 | Barber | |
| 2002/0125092 | A1 | 9/2002 | Nykoluk et al. | |
| 2003/0070948 | A1 | 4/2003 | Barber et al. | |

* cited by examiner

*Primary Examiner*—David T. Fidei
(74) *Attorney, Agent, or Firm*—Lerner, David, Littenberg, Krumholz & Mentlik, LLP

(57) ABSTRACT

A portable display apparatus and method for transporting and displaying sample products along with an electronic device is disclosed. The portable display apparatus comprises a container, a platform, and a cover, wherein the cover is removably attached to the container. Removal of the cover allows for both a display portion and compartments within the container to be accessed. The present invention is useful in presenting a product to prospective customers at any location necessary.

30 Claims, 8 Drawing Sheets

PORTABLE LAPTOP DISPLAY AND STORAGE APPARATUS

FIELD OF THE INVENTION

This invention relates to the field of protective cases and more particularly, to protective cases for the transport and display of electronic devices and sample products.

BACKGROUND OF THE INVENTION

The life of a salesman or company representative is a tumultuous one. Constant travel is often required, and with such travel comes the logistical problems of transporting sample wares and presentation equipment. Whether it be driving from point A to point B, or traveling by aircraft, more equipment means a more difficult commute. For years, the daily life of a salesman has been further complicated by these factors.

Often times, a salesman will have sample products or devices and other equipment, such as a laptop computer. These products are often necessary to make a presentation to a prospective client or purchaser. However, the transportation of such materials is difficult. Expensive laptop computer equipment is often fragile and requires specially tailored carrying cases. Similarly, the products or devices being peddled are fragile and may also require special accommodations. Many times this requires the use of more than one carrying case and/or container. With each additional case, the complications involved in transportation of such increase.

Additionally, a salesman may require a display space for making a pitch or presentation. Often, cases utilized in transporting presentation equipment and various wares must be stored. This may further complicate the situation and possibly clutter the display space. Therefore, there is a need to provide a carrying case that can properly embrace both a presentation device and a sample ware, while also providing a transportable display area for both.

SUMMARY OF THE INVENTION

A portable display apparatus comprising a container including a front wall, a rear wall, a bottom wall, two adjacent side walls, and an opening wherein the container includes at least one compartment therein, a surface for holding an electronic device associated with one of the at least one compartments in the body, and a cover for removable engagement to the container including a top member that covers the opening, wherein removal of the cover allows the at least one compartment to be accessed.

A display apparatus and carrying case comprising a container including a front wall for displaying a product, a rear wall, a bottom wall, two adjacent side walls, and an opening wherein the container includes three compartments therein, a platform for holding an electronic device associated with one of the three compartments in the body, wherein the platform is slidably engaged with the body, and a cover for removable attachment to the container including a front member that covers a substantial portion of the front wall, a top member that covers the opening, and rear member that covers at least a portion the rear wall, wherein removal of the cover allows the three compartments to be accessed and the front wall of the container to be exposed.

A method of displaying a product comprising placing a product on an exterior surface of a portable display apparatus including at least one internal compartment, disposing an electronic device including a display screen and a main body in said at least on internal compartment, such that the display screen of the electronic device is visible to a person viewing the product on the surface while the main body of the electronic device is contained with the at least one compartment.

A method of displaying a product comprising providing a portable display apparatus including a container having a front wall, a rear wall, a bottom wall, two adjacent side walls, and on opening where the container includes at least one compartment therein, a surface for holding an electronic device associated with on the at least one compartments in the body, and a cover for removable engagement to the container including a front member that covers at least a portion of the front wall, a top member that covers the opening, wherein removal of the cover allows the at least one compartment to be accessed, storing at least on product within the display apparatus, storing at least one electronic device within the display apparatus, removing the cover from the container, displaying a portion of the electronic device, and displaying the at least one product.

A portable display and storage apparatus comprising a container having a compartment for holding an electronic device, a flat planar display surface adjacent the compartment, such display surface being aesthetic and suitable for display of products in sales presentations, and an opening providing access to the compartment and allowing a display screen of an electronic device stored in the compartment to extend substantially above and adjacent the display surface.

BRIEF DESCRIPTION OF THE DRAWINGS

The present invention will be better understood on reading the following detailed description of non-limiting embodiments thereof, and on examining the accompanying drawings, in which.

DETAILED DESCRIPTION

In describing the preferred embodiments of the subject matter illustrated and to be described with respect to the drawings, specific terminology will be resorted to for the sake of clarity. However, the invention is not intended to be limited to the specific term so selected, and is to be understood that each specific term includes all technical equivalence which operate in a similar manner to accomplish a similar purpose.

Figure 1:
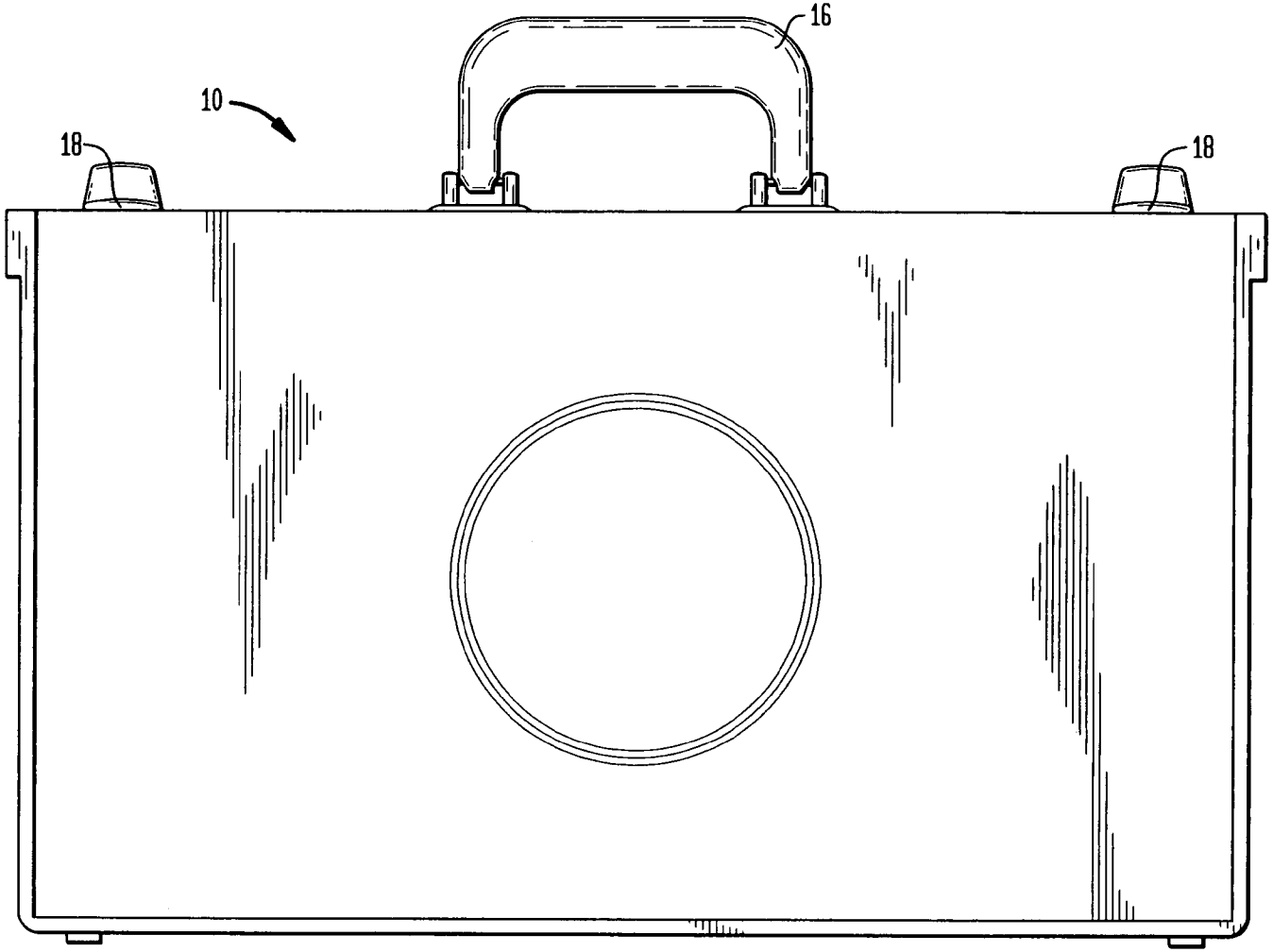
FIG. 1 is a front view of the apparatus according to an embodiment of the present invention.
Figure 2:
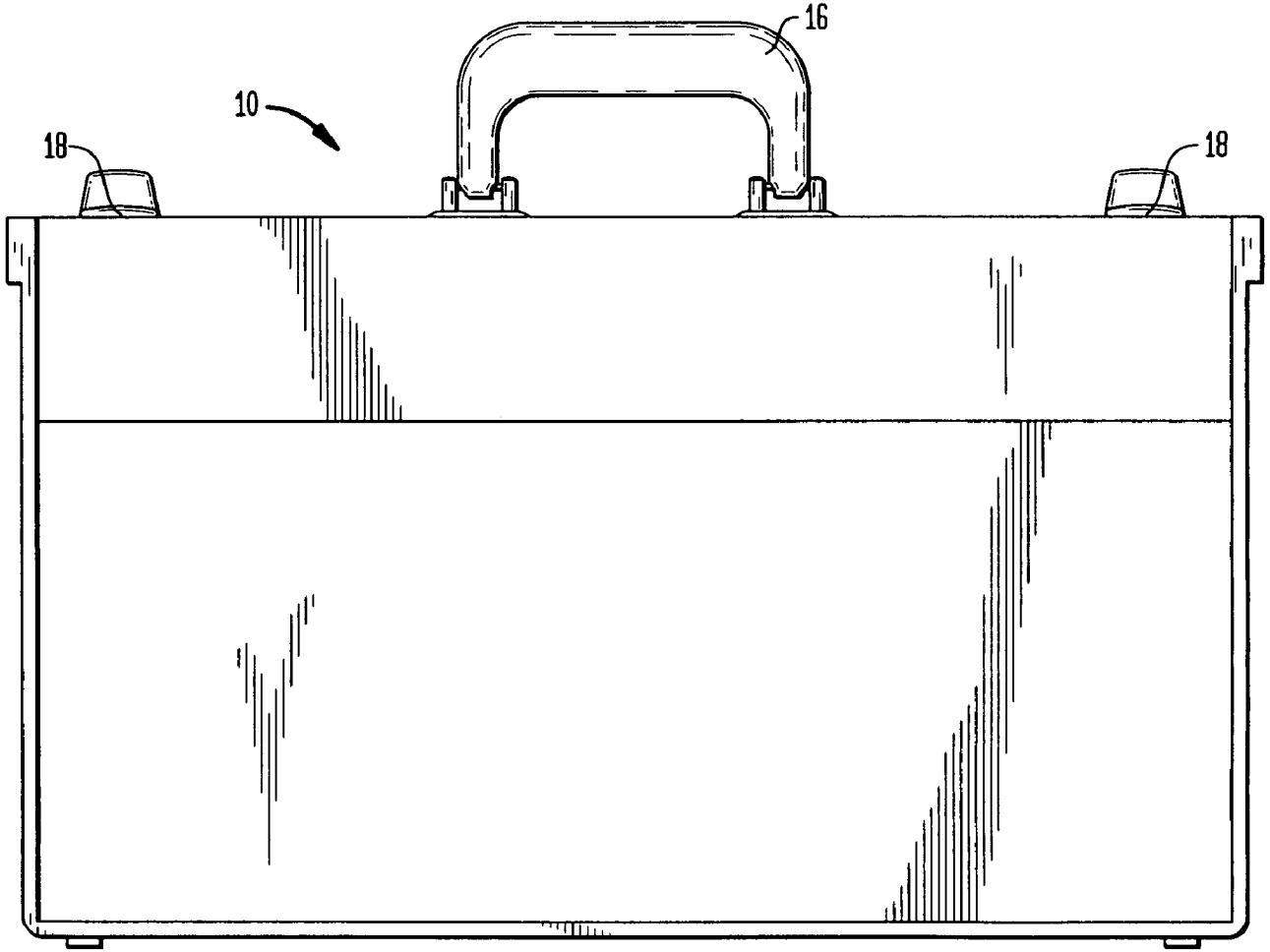
FIG. 2 is a rear view of the apparatus according to an embodiment of the present invention.
Figure 3:
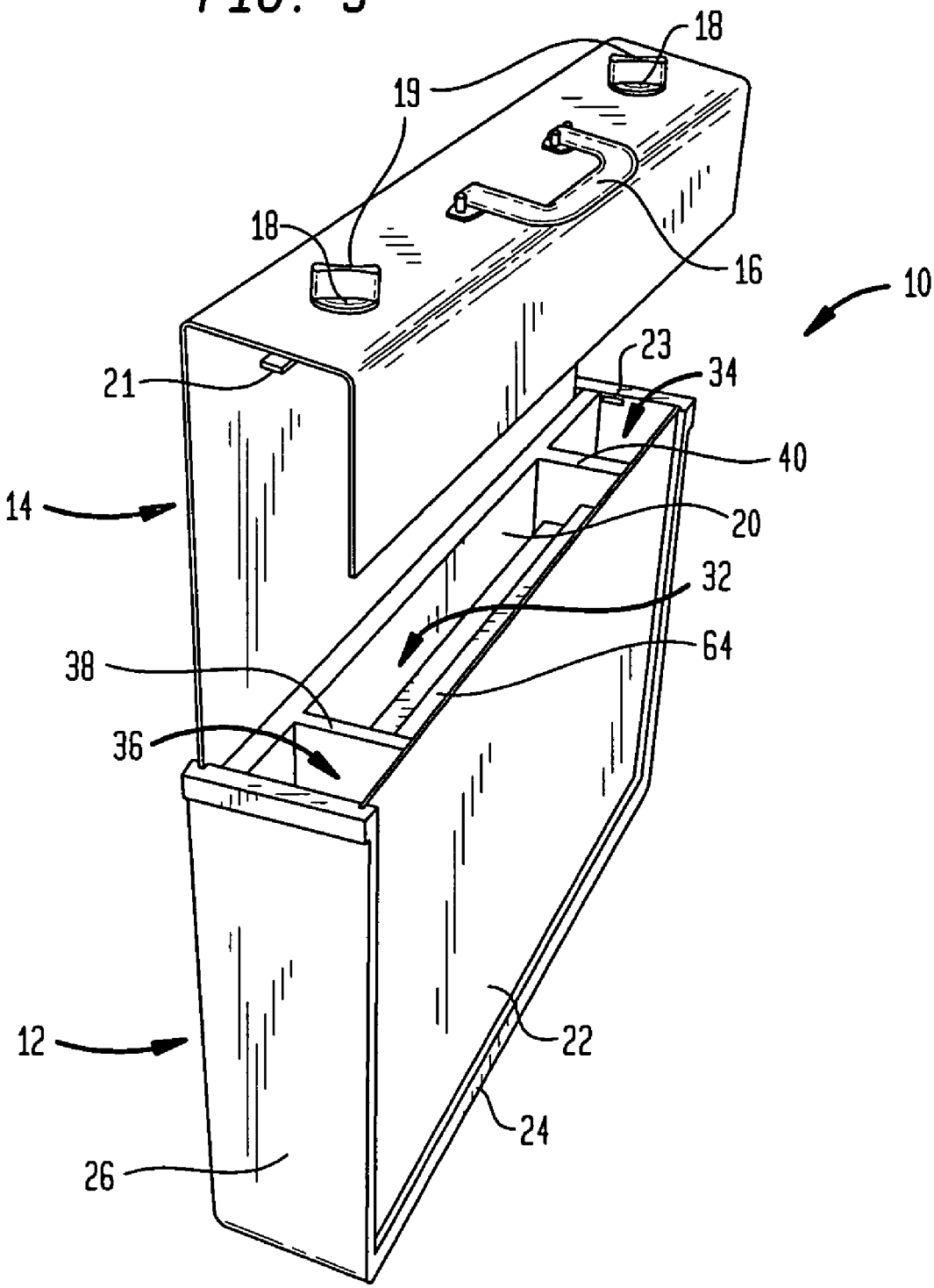
FIG. 3 is a perspective view of the apparatus according to an embodiment of the present invention with the cover partially removed, wherein the internal compartments can be seen.

Referring to the drawings, wherein like reference numerals represent like elements, there is shown in FIGS. 1 and 2, in accordance with one embodiment of the present invention, a portable display case designated generally by reference numeral 10. In a preferred embodiment, the case 10 includes container 12 and cover 14. As best shown in FIG. 3, cover 14 is removably attached to container 12 in a manner more fully set forth below. Cover 14 further includes handle 16 for facilitating easy transport of the case 10, and fasteners 18 for securing the cover 14 to the container 12. Case 10 is shown as being constructed of substantially rigid material. However, it is contemplated that other materials can be utilized. For example, the entire case, or portions thereof, can be constructed of soft woven material or other textile material.

Figure 4:
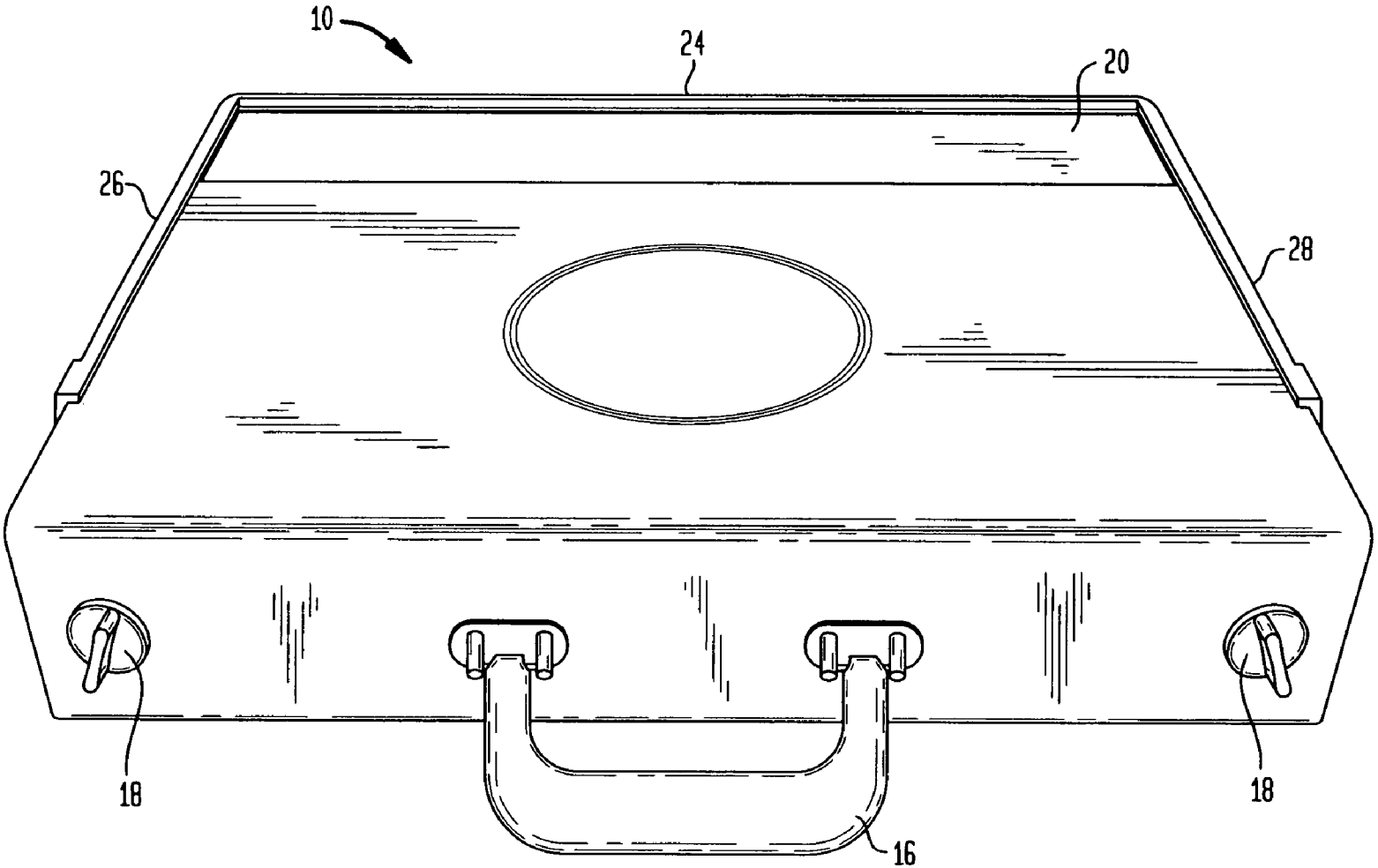
FIG. 4 is a perspective view of the apparatus according to an embodiment of the present invention with the cover partially removed.

Referring now to FIGS. 3 and 4, there is shown case 10 with cover 14 partially removed from container 12. FIG. 3 shows the interior of container 12 housing an electronic device 64 and sample wares 70 (not shown). The interior of container 12 is defined by front wall 20, rear wall 22, bottom wall 24, two side walls 26, 28, and opening 30. In a preferred embodiment, the interior of container 12 includes a surface for holding an electronic device, which may be in the form of a platform compartment 32 and two storage compartments 34 and 36. Platform compartment 32 and storage compartments 34 and 36 are further defined by interior walls 38 and 40. These walls extend from bottom wall 24 to opening 30, thereby defining three separate compartments. Upon the placement of cover 14 on container 12, the three compartments are completely enclosed to form three separate compartments. It is contemplated that any number of compartments may be included in the interior of container 12. In addition, it is contemplated that the compartments may be of any size and/or shape.

Figure 5:
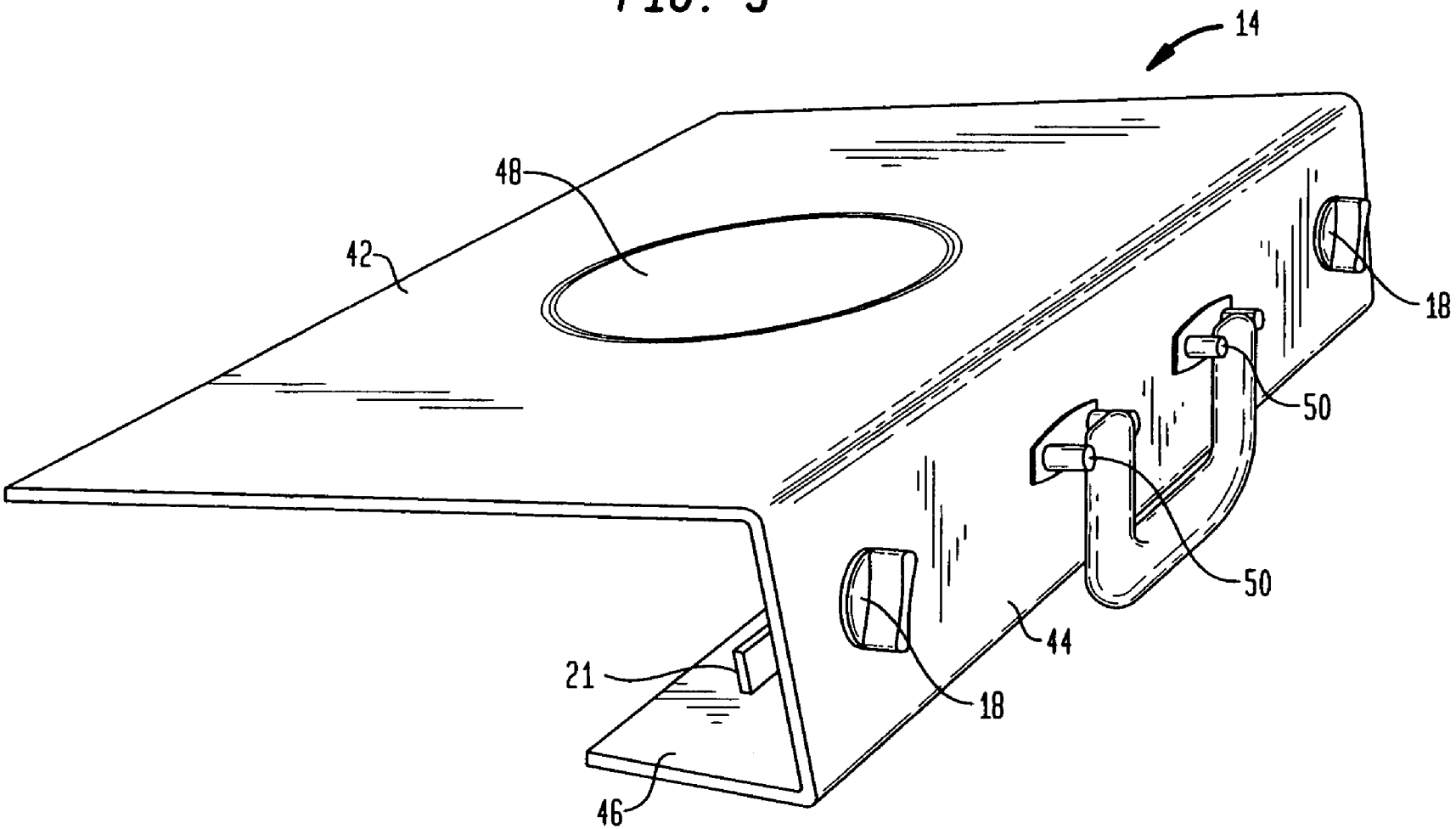
FIG. 5 is a perspective view of the cover according to an embodiment of the present invention.

FIG. 5 shows cover 14 removed from container 12. Cover 14 includes front member 42, top member 44, and rear member 46. The cover of the preferred embodiment is substantially J-shaped. In this preferred embodiment, when cover 14 is attached to container 12, front member 42 substantially covers front wall 20 and rear member 46 covers a portion of rear wall 22. When attached, top member 44 completely covers opening 30, thereby enclosing platform compartment 32 and storage compartments 34 and 36. It is contemplated that front member 42, top member 44, and/or rear member 46 may cover any portion of the respective areas of container 12. In another embodiment, both front member 42 and rear member 46 substantially cover front wall 20 and rear wall 22 respectively, while top member substantially covers opening 30. It is also contemplated that cover 14 may include additional members (not shown). In this embodiment, cover 14 is tube shaped thereby covering all surfaces of container 12 except one such surface. This would allow cover 14 to attach to container 12 by sliding over its exterior, only leaving one surface uncovered. The surface left uncovered can be any surface on container 12. For example, in one embodiment, the surface of side wall 26 can be left uncovered, while in another embodiment, the surface of bottom wall 24 can be left uncovered. However, it is contemplated that various other combinations can be utilized.

FIG. 5 further depicts other components of the cover 14. Cover indicia 48 can be seen on front member 42. Markings of this sort can be utilized to signify something about the product to be displayed, for example the product name or company name or logo. However, other uses for cover indicia 48 are contemplated. It is contemplated that cover indicia 48 can be excluded from the present invention or easily interchanged to allow for the displaying of different products with the use of the same case 10. Handle 16 can also be seen including hinges 50. Hinges 50 allow for handle 16 to be folded against cover 14 and extended while case 10 is being transported by a person. It is contemplated that other handle connections can be utilized for mounting handle 16 to cover 14. For example, it is contemplated that handle 16 can be folded into a recess located on top member 44 of cover 14, to allow less of a profile while storing. Similarly, a fixed or non-folding handle can be employed. It is also contemplated that a shoulder strap or other means allowing for easier transport can be included. Various combinations can be used as known to one of ordinary skill in the prior art.

Figure 6:
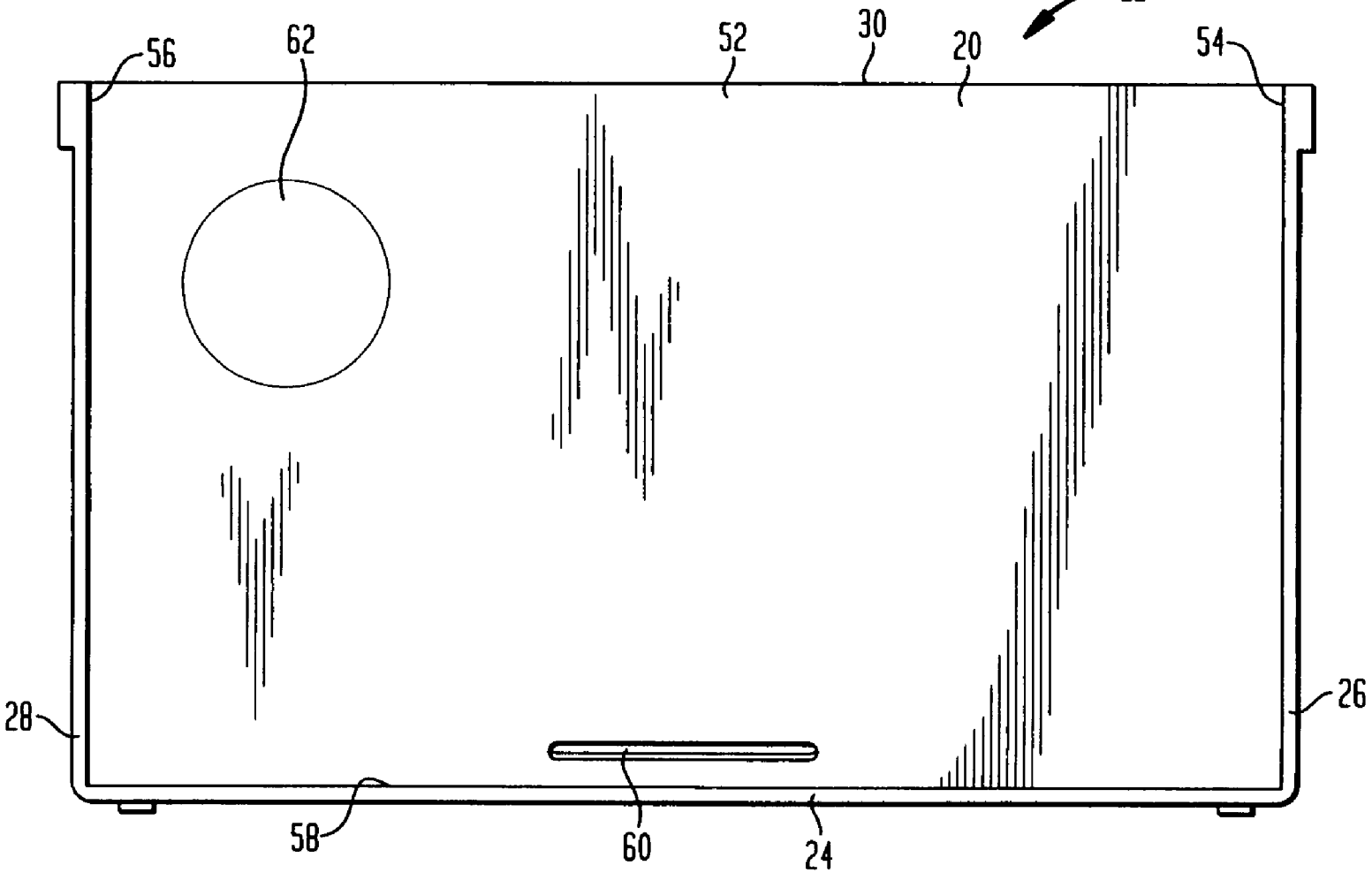
FIG. 6 is a front view of the container according to an embodiment of the present invention.

FIG. 6 shows container 12, without cover 14, rested in its display position. In the display position, rear wall 22 of container 12 is placed against a surface. This allows for front wall 20 to face upwards, the position generally utilized for displaying both an electronic device and various wares. Pliable material 52 is shown covering front wall 20. This material is utilized to better facilitate the display of the various wares. Material of this type provides a higher frictional coefficient, thereby providing better holding of the various instruments thereon. Further, material of this type is utilized to better protect fragile instruments from placement on the surface. In a preferred embodiment, pliable material 52 is a rubber-like material. However, it is contemplated that other materials can be utilized. Additionally, it is contemplated that front wall 20 may be entirely made of such material or only portions thereof may be covered. Finally, it is contemplated that front wall 20 may be left uncovered.

FIG. 6 also illustrates the apparatus used in slidably attaching the cover 14 to the container 12. In a preferred embodiment, as shown in FIG. 6, a portion of bottom wall 24 and side walls 26 and 28 extends beyond the pliable material 52, which covers front wall 20. Included on each of these portions is a slot for receiving three edges of front member 42 of cover 14. Side wall 26 includes side slot 54, side wall 28 includes side slot 56, and bottom wall includes bottom slot 58. Each of the respective slots 54, 56, and 58 is slightly wider than the width of front member 42 of cover 14. The side slots 54 and 56 are open at their end adjacent to opening 30. Upon attachment of cover 14 to container 12, front member 42 is slid into side slots 54 and 56 at their open ends. To effectuate closing of case 10, front member 42 is slid into slots 54 and 56 until top member 44 rests against opening 30 and a portion of front member 42 rests in bottom slot 58. In this closed position, rear member 46 extends over rear wall 22, thereby covering a portion thereof. An example of the preferred embodiment in this closed position can be seen in FIGS. 1 and 2.

It is contemplated that any portion of front wall 20 or rear wall 22 may be covered by front member 42 and rear member 44, respectively. For example, in another embodiment, cover 14 of the present invention may be substantially U-shaped. Similar to the attachments means set out above, bottom wall 24 and side walls 26 and 28 may extend beyond both the front wall 20 and the rear wall 22. In this embodiment, both the front member 42 and the rear member 46 are slid into slots on either sides of the side walls 26 and 28. Upon the covering of opening 30, portions of both front member 42 and rear member 46 rest in bottom slots situated on the extended portions of bottom wall 24. Furthermore, it is contemplated that other modes, known to those of ordinary skill in the art, of attaching cover 14 to container 12 can be employed. For example, cover 14 can be hingeably attached to container 12.

As mentioned above, it is also contemplated that cover 14 may include additional members (not shown). In this embodiment, cover 14 is tube shaped thereby covering all surfaces of container 12 except one such surface, and cover 14 is attached to container 12 by sliding over its exterior, only leaving one surface uncovered. Here, there is no need for the extensions of the various walls, or the slots located therein. Cover 14 simply encompasses all surfaces except one, which can be any surface on container 12.

Referring now to FIGS. 3 and 5, the fasteners 18 of the cover 14 to the container 12 are shown. Fasteners 18 are employed to retain cover 14 on container 12. Fasteners 18 include knobs 19 and arms 21. Knobs 19 are connected to arms 21 wherein rotational movement of knobs 19 provides corresponding rotational movement to arms 21. Upon attachment of cover 14 to container 12, and the covering of opening 30, knobs 19 are rotated to cause arms 21 to engage notch 23. This coupling provides a fixed attachment of cover 14 to container 12, and allows for the transportation of case 10 through the use of handle 16. It is contemplated that other fixable attachment means may be employed, for example, mechanical locking devices requiring a key or other means as known in the ordinary art. It is also contemplated that any number of fasteners 18 can be used, for example, in one embodiment, only one fastener is required.

In a preferred embodiment, shown in FIG. 6, front wall 20 includes a vent opening 60 to permit cooling of an electronic device contained therein. The vent opening 60 is shown as an elongated opening that extends through front wall 20 and pliable material 52. However, it is contemplated that any shape or plurality of shapes can be utilized. For example, a plurality of circular holes can be dispersed on front wall 20. Generally, the vent opening 60 is situated in an area that corresponds to a heat producing region of the electronic device. FIG. 6 also shows front wall indicia 62. Like cover indicia 48, front wall indicia 62 is utilized to signify something about the product to be displayed, for example the product name or company name. However, other uses for front wall indicia 62 are contemplated. It is contemplated that front wall indicia 62 can be excluded from the present invention or easily interchanged to allow for the displaying of different products. Finally, container 12 may include external speakers or other sound amplifying devices (not shown). The storage of electronic device 64 within container 12 may muffle or block any sound amplifying means included in electronic device 64. Therefore, container 12 may include external speakers or other sound amplifying devices for connection with electronic device 64. For example, container 12 may include small speakers, as known in the art, with electronic connections for coupling with like connections (i.e. audio output ports) of electronic device 64. These small speakers may be situated in any manner that allows any sound to be properly amplified. In one embodiment, the speakers are attached to container 12 so that a portion of the speakers extend through front wall 20.

Figure 7:
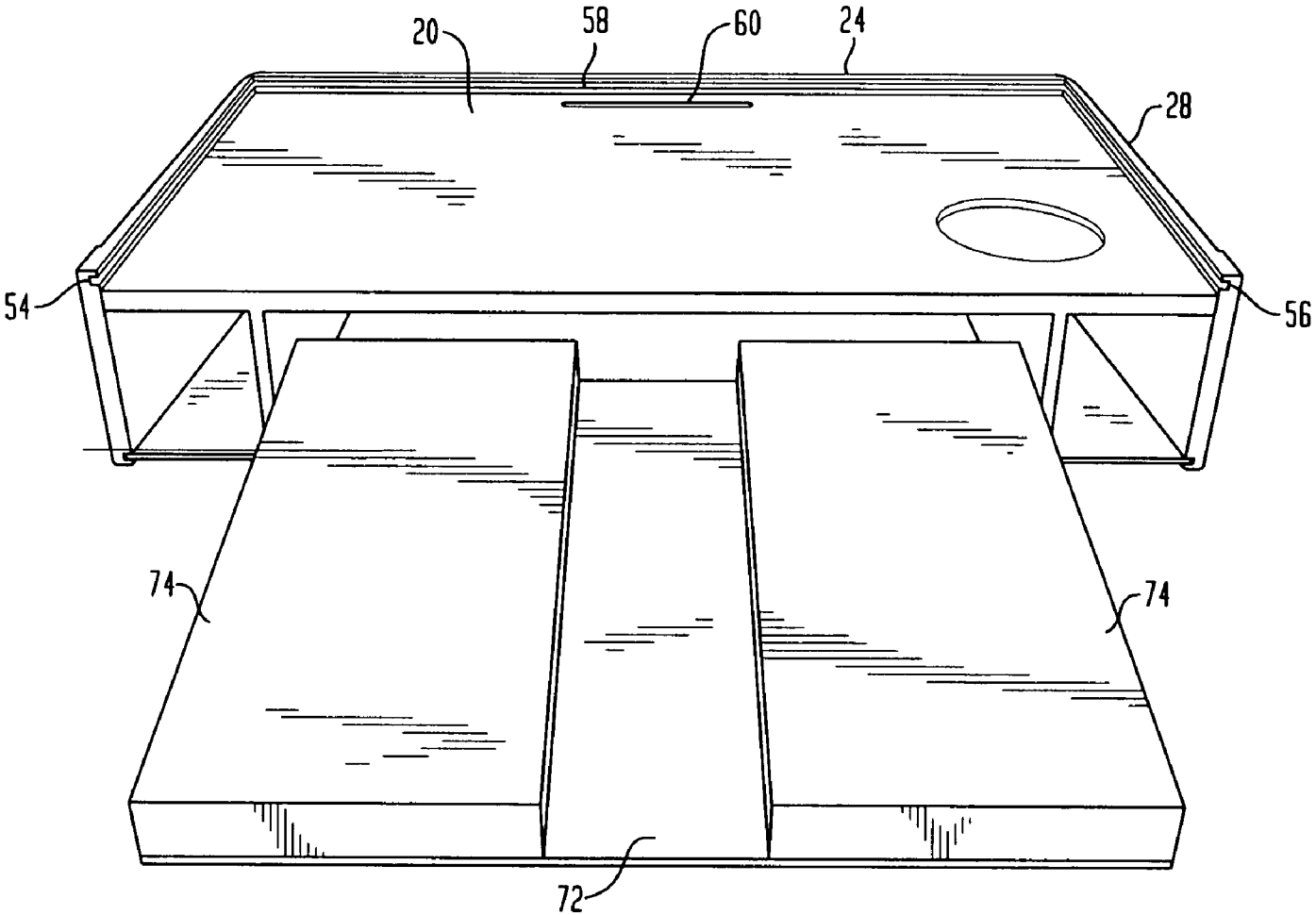
FIG. 7 is a perspective view of the container according to an embodiment of the present invention, wherein the compartments and the platform can be seen; and, FIG. 8 is a perspective view of the container according to an embodiment of the present invention, wherein the display of the electronic device and instruments can be seen.

FIG. 7 depicts the platform 72 and its relation to the present invention. Platform 72 includes pads 74 for supporting electronic device 64. Platform 72 is slidably interposed within platform compartment 32 of container 12. In a preferred embodiment, the width dimensions of platform 72 are slightly smaller than those of platform compartment 32. Similarly, the height dimensions of platform 72 with electronic device 64 disposed thereon are slightly smaller than those of platform compartment 32. This allows for the easy removal of platform 72 and displaying of the display portion 66 of electronic device 64. In a preferred embodiment, the user simply slides the entire platform 72, with the electronic device 64 disposed thereon, out from the platform compartment 32, displays the display portion 64, and slides the entire platform 72 back into the platform compartment 32, so that body 68 of electronic device 64 remains therein.

It is contemplated that other embodiments of the platform 72 can be utilized. For example, in one embodiment, platform 72 can be connected to platform compartment 32 by extendable attachment means. One such example of this embodiment, which is known in the art, is a series of rails that are interposed with respect to one another and extend upon the application of force. In another embodiment, platform 72 includes wheels that allow for easy removal with respect to container 12. In yet another embodiment, platform 72 is fixed within platform compartment 32 and to container 12 or constructed integrally with container 12. In this embodiment, removal of the electronic device 64 is achieved by movement of the electronic device 64, rather than the platform 72. It is contemplated that pads 74 can be of any size, shape or material and may or may not be employed in the various embodiments. It is also contemplated that the dimensions of the platform compartment may vary depending on the electronic device dimensions and/or embodiment of platform employed. It should be noted that various combinations of the above embodiments are contemplated.

Figure 8:
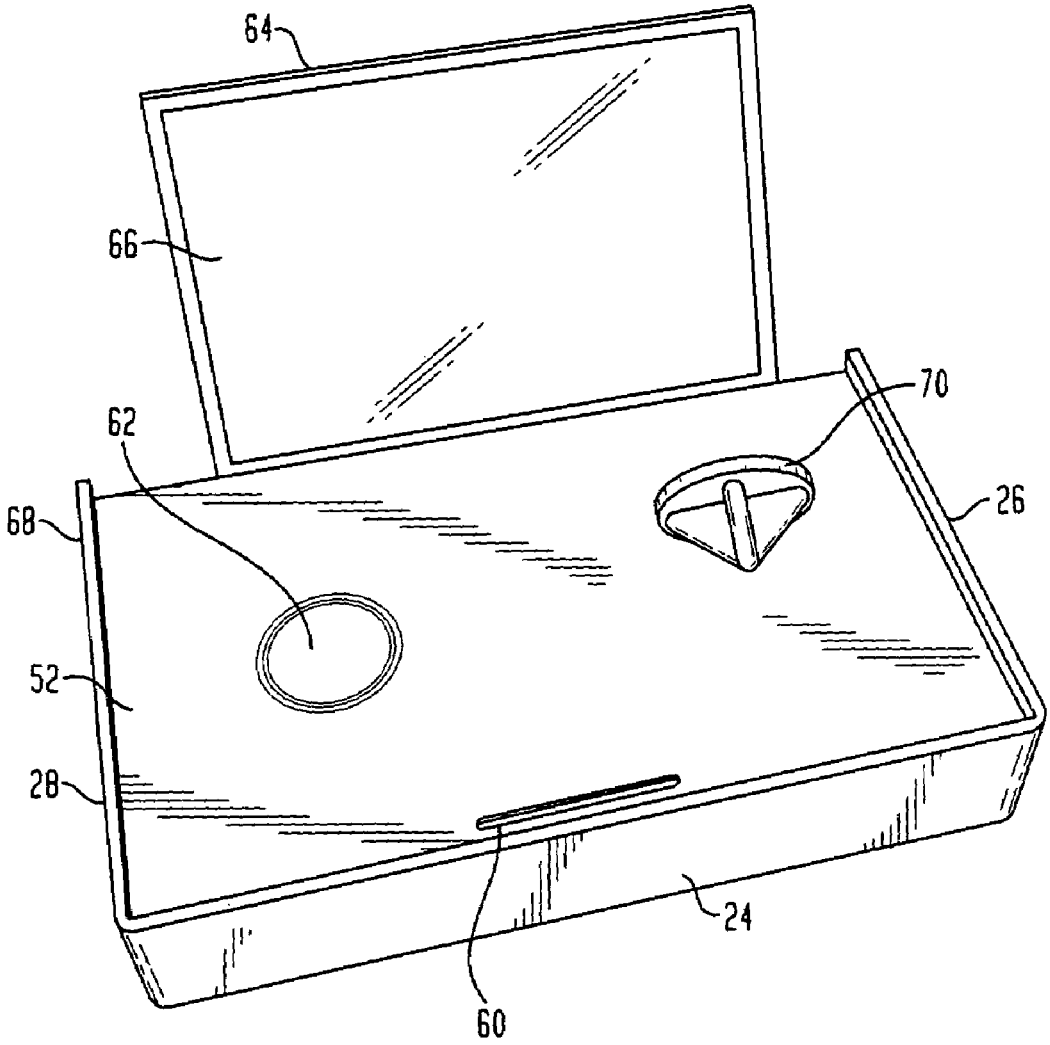

FIG. 8 shows the apparatus in use to display a product. As shown, cover 14 (not shown) is removed from container 12, and rear wall 22 is placed on a surface. Display portion 66 of electronic device 64 can be seen protruding above front wall 20. Body 68 (not shown) of electronic device 64 is contained within platform compartment 32 of container 12. Products 70 are disposed on pliable material 52 of front wall 20. This allows a user to simultaneously show a front wall indicia 62, an image or multiple images on display portion 66, and products 70. In one embodiment, electronic device 64 is a portable or laptop computer, and a presentation, corresponding to products 70, is shown on its display. In this embodiment, display portion 66 of the portable or laptop computer is preferably fully viewable, but also may be 75% viewable, or more preferably 90% viewable. It is contemplated that other electronic devices can be utilized. It is also contemplated that different variations of the above discussed elements can be used. For example, in one embodiment, cover 14 can be utilized to increase the display size of front wall 20. In this embodiment, cover 14 is situated so that front member 42 aligns with front wall 20. In this situation, rear member 46 provides contact between the cover 14 and the surface upon which the display case 10 is located. Means for attaching cover 14 to container 12 in this manner may be included.

Another aspect of the invention relates to a method of displaying products, generally in a sales or informational sense. A method according to one embodiment of the present invention includes placing a product on an exterior surface of a portable display apparatus and disposing a display screen of an electronic device, while the body of the electronic device is contained within the portable display apparatus. The display screen of the electronic device is utilized to show an image or group of images thereon, relating to an aspect of the product being displayed. Additionally, the product and the electronic device can easily be stored within the portable display apparatus for transport. It is recognized that many variations of performing this method can be performed, and that many variations of the portable display apparatus can be employed.

In a preferred embodiment of the method of the present invention, a preferred portable display apparatus 10, as discussed above, is employed. The user stores at least one product or instrument 70 within one of the storage compartments 34 and 36 and an electronic device 64 having a display portion 66 and body 68 within the platform compartment 32. In a preferred embodiment, electronic device 64 is a laptop computer. The user transports the apparatus 10 with the electronic device 64 and the instruments 70 to a destination. Cover 14 is then removed from container 12. This may require the facilitation fasteners 18, but this step is not necessary in all embodiments. The apparatus 10 is then placed on its rear wall 22, so that front wall 20 covered with pliable material 52 faces upward.

The user then removes both the laptop computer on the platform 72 and instruments 70. The instruments 70 are placed on the pliable material 52 of front wall 20. The laptop is opened and the body of the laptop along with platform 72 is slid back into the platform compartment 32 of the container 12. This allows for the screen of the laptop to remain in a viewable position relative to the front wall 20 and the products 70 placed thereon. It is contemplated that the laptop can be removed in various fashions in accordance with the different embodiments of the platform 72 as set forth above. With both the laptop and the instruments 70 in these positions, an image or group of images (presentation) may be viewed on the screen of the laptop, while the products 70 are also in view. Additionally, a front wall indicia 62, which corresponds to the instruments 70, may be viewed. This method allows for an impressive presentation to be provided at almost any location required of a user.

The instruments 70 referred to throughout can be of any type or related to any field of use. In a preferred embodiment, instruments 70 relate to medical devices and more particularly to devices used in orthopedics. However, it is contemplated that various instruments, within various fields can be used in conjunction with the present invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A portable display apparatus comprising:

a. a container including a front wall, a rear wall confronting but not touching said front wall, a bottom wall connected to said front and rear walls, two adjacent side walls connected to said front, rear, and bottom walls, and an opening wherein said container includes at least one compartment therein, said at least one compartment being enclosed by said front, rear, bottom, and side walls, and accessible through said opening;

b. a surface for holding an electronic device associated with one of said at least one compartments in said body; and, c. a cover for removable engagement with said container including a top member that covers said opening and a rear member that covers at least a portion of the rear wall, wherein removal of said cover allows said at least one compartment to be accessed.

2. The portable display apparatus of claim 1, wherein said cover further includes a front member that covers at least a portion of said front wall.

3. The portable display apparatus of claim 1, wherein said surface includes a platform slidably engaged with said container.

4. The portable display apparatus of claim 1, wherein said cover is removably attached to said container.

5. The portable display apparatus of claim 1, wherein removal of said cover allows said front wall of said container to be exposed.

6. The portable display apparatus of claim 1, wherein said front wall of said container includes an opening for venting and/or cooling the electronic device.

7. The portable display apparatus of claim 1, wherein said front wall of said container includes a portion for displaying indicia thereon.

8. The portable display apparatus of claim 1, wherein said front wall includes a thin layer of pliable material.

9. The portable display apparatus of claim 1, wherein said container includes two compartments therein, one of said compartments for storage of said electronic device and one of said compartments for storage of at least one product.

10. The portable display apparatus of claim 1, wherein said container includes three compartments therein, one of said compartments for storage of said electronic device and two of said compartments for storage of at least one product.

11. The portable display apparatus of claims 9 or 10, wherein said product is a medical device.

12. The portable display apparatus of claim 11, wherein said medical device is an orthopedic device.

13. The portable display apparatus of claim 1, further comprising at least one latch allowing for removable attachment of said cover to said container.

14. The portable display apparatus of claim 1, wherein said electronic device is a laptop computer including a screen and a body.

15. The portable display apparatus of claim 14, wherein said body of said laptop computer is completely interposed within said at least one compartment of said container while said display screen of said laptop computer is visible.

16. The portable display apparatus of claim 1, wherein said cover includes a handle.

17. The portable display apparatus of claim 1, wherein said cover is substantially J-shaped.

18. The portable display apparatus of claim 3, wherein said platform is detachable from said container.

19. A display apparatus and carrying case comprising:

a. a container including a front wall for displaying a product, a rear wall confronting but not touching said front wall, a bottom wall connected to said front and rear walls, two adjacent side walls connected to said front, rear, and bottom walls, and three openings wherein said container includes three compartments therein, said compartments being enclosed by said front, rear, and bottom walls, and accessible through said openings;

b. a platform for holding an electronic device associated with one of said three compartments in said body, wherein said platform is slidably engaged with said body; and, c. a cover for removable attachment to said container including a front member that covers a substantial portion of said front wall, a top member that covers said opening, and a rear member that covers at least a portion of said rear wall, wherein removal of said cover allows said three compartments to be accessed through said openings and said front wall of said container to be exposed.

20. The display apparatus and carrying case of claim 19, wherein said electronic device is a laptop computer including a display screen and a body.

21. The display apparatus and carrying case of claim 20, wherein said platform and said body of said laptop computer are completely interposed within said container while said display screen of said laptop computer is visible.

22. A portable display and storage apparatus comprising a. a container having a compartment for holding an electronic device, a flat planar display surface adjacent but not within said compartment, said display surface being suitable for display of products in sales presentations, and an opening providing access to said compartment and allowing a display screen of an electronic device stored in said compartment to extend substantially above and adjacent said display surface; and b. a cover removably attached to said container, said cover capable of covering said opening of said container and at least a portion of said display surface.

23. The portable display and storage apparatus of claim 22, further comprising an electronic device having a display screen.

24. The portable display and storage apparatus of claim 22, wherein at least 75% of said display screen extends above said display surface.

25. The portable display and storage apparatus of claim 22, wherein at least 90% of said display screen extends above said display surface.

26. The portable display and storage apparatus of claim 22, wherein said cover covers at least a portion of said display surface.

27. The portable display and storage apparatus of claim 26, wherein said cover substantially covers said display surface.

28. The portable display and storage apparatus of claim 22, further comprising indicia.

29. The portable display apparatus of claim 2, wherein said side walls include grooves adjacent said front wall, said grooves adapted for slidably receiving said front member of said cover.

30. The display apparatus and carrying case of claim 19, wherein said side walls include grooves adjacent said front wall, said grooves adapted for slidably receiving said front member of said cover.

* * * * *